United States Patent [19]

Morbidi

[11] 4,235,078

[45] Nov. 25, 1980

[54] CRYOGENIC EQUIPMENT FOR VERY LOW TEMPERATURES

[75] Inventor: Piero Morbidi, Siena, Italy

[73] Assignee: Officine Galileo S.p.A., Milan, Italy

[21] Appl. No.: 20,435

[22] Filed: Mar. 14, 1979

[30] Foreign Application Priority Data

Mar. 16, 1978 [IT] Italy ..... 9377 A/78

[51] Int. Cl.[3] ..... F25B 9/00

[52] U.S. Cl. ..... 62/6

[58] Field of Search ..... 62/6

[56] References Cited

U.S. PATENT DOCUMENTS

| | | | |
|---|---|---|---|
| 3,119,237 | 1/1964 | Gifford | 62/6 |
| 3,188,818 | 6/1965 | Hogan | 62/6 |
| 3,367,121 | 2/1968 | Webb | 62/6 |
| 3,640,082 | 2/1972 | Dehne | 62/6 |
| 4,092,833 | 6/1978 | Durenec | 62/6 |

*Primary Examiner*—Lloyd L. King

*Attorney, Agent, or Firm*—Hopgood, Calimafde, Kalil, Blaustein & Lieberman

[57] ABSTRACT

A closed cycle gas cooling apparatus capable of producing very low temperatures (lower than 100° K.) is provided. The apparatus utilizes a combined cycle with the gas expanding and working against a piston, as well as expansion by means of an evacuating compressor system. The expanding gas can be used to act on the piston motor shaft, so that the work effected by the gas during expansion accelerates the motor which operates as a brake, accumulating energy for a subsequent phase in which the piston lowers again.

5 Claims, 10 Drawing Figures

Fig.2B
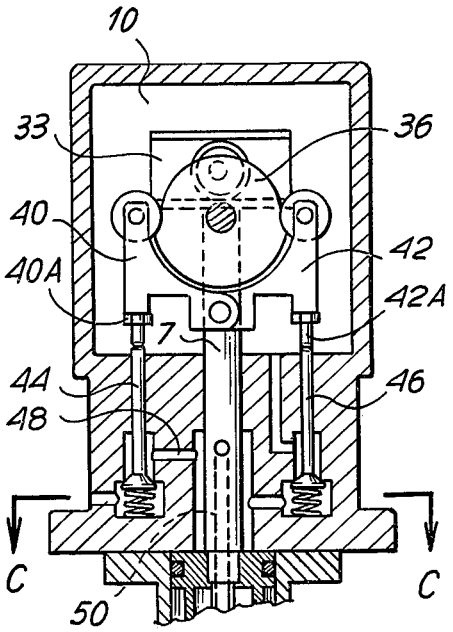
Fig.2A
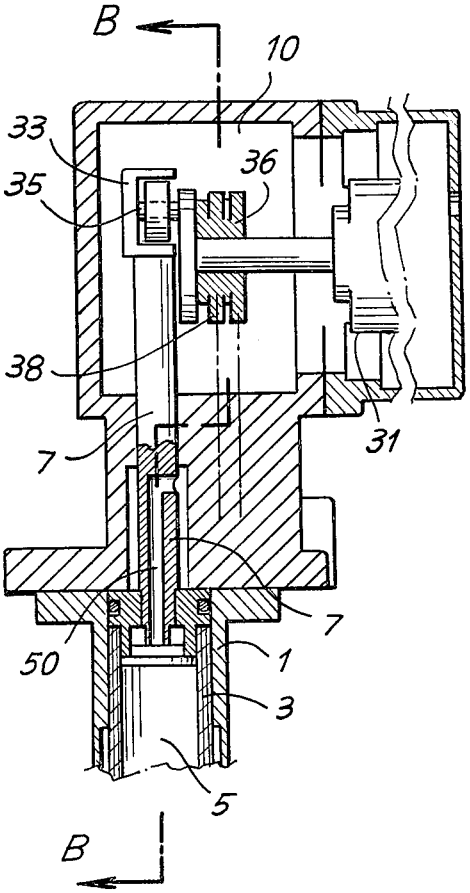
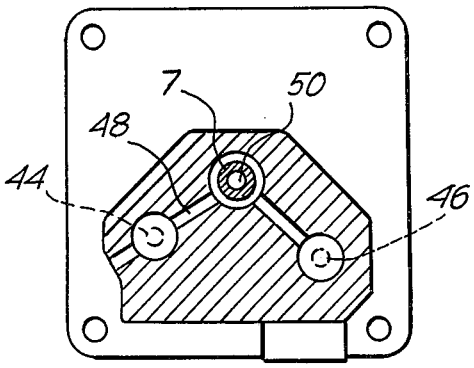
Fig.2C

Fig.3
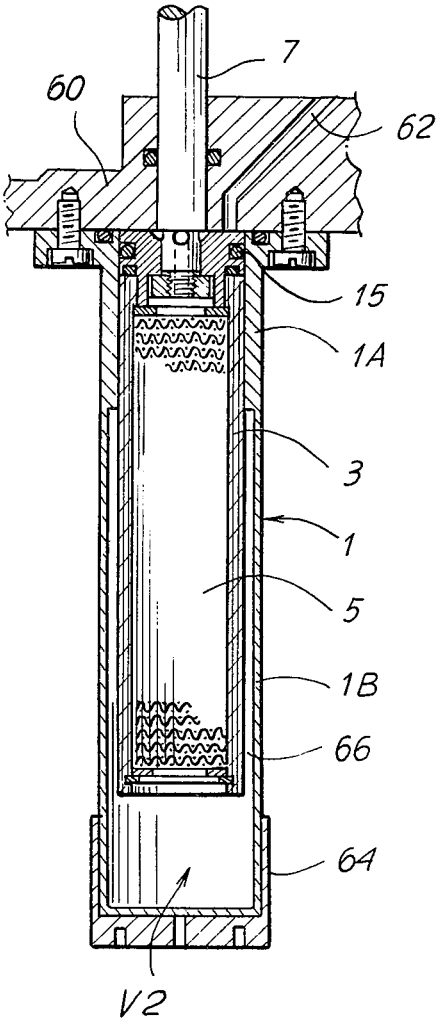
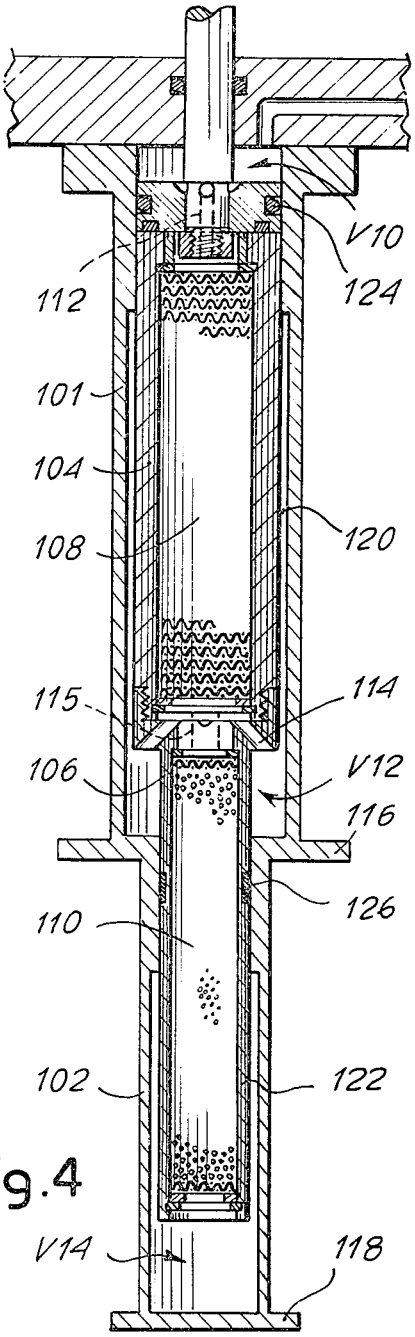
Fig.4

CRYOGENIC EQUIPMENT FOR VERY LOW TEMPERATURES

BACKGROUND AND SUMMARY OF THE INVENTION

The present invention relates to closed cycle gas refrigerating equipment capable of generating a cooling effect for uses in which low temperatures (lower than 100° K.) on small surfaces are required.

Devices are known which produce such an effect. Among these known devices, some obtain the cooling action by virtue of gas working against a piston; other known devices obtain the same effect through gas expansion by virtue of an evacuating and pressurizing compressor. All of these devices are provided with a heat exchanger inside the piston.

The object of the present invention is an improved device for obtaining the foregoing purposes, in which the refrigeration is obtained by combining the two above stated principles. Therefore, a closed cycle cooling apparatus according to the present invention is capable of producing very low temperatures (lower than 100° K.). The apparatus is characterized in that it completes a combined cycle with both gas expansion and gas working against a piston, and expansion by means of an evacuating compressor system. In a preferred embodiment the piston on which the expanding gas acts is used to act on the piston shaft motor, so that the work effected by the gas during expansion accelerates the motor which acts as a brake, accumulating energy for a subsequent phase in which the piston lowers again. The piston may have a shaft extending from the previously compressed gas expansion region, and the shaft together with the control unit is placed in a region at the low pressure provided by the evacuating compressor. In this low pressure area the delivery valves open, and the area compensates the differences occurring between the cryogenic unit gas input rate and the evacuating unit suction rate.

A piston against which the gas works is separated from the outer cylinder by means of an annular cavity extending from the room temperature area to the cryogenic temperature.

A one-stage piston may include an axial passage to permit gas inlet and outlet. A two-stage piston may also have an axial passage to allow gas inlet and outlet.

The invention will be better understood in connection with the specification to follow and the annexed drawings; which show a non-limitative embodiment of the invention itself.

BRIEF DESCRIPTION OF THE DRAWING

In the drawings:

FIGS. 2A, 2B and 2C show a plurality of views of the rod and valve unit, such an embodiment being usable with either a one-stage or two-stage piston;

FIG. 3 shows the one-stage apparatus to produce low temperatures; and

FIG. 4 shows the basic parts of the two-stage apparatus.

DESCRIPTION OF THE PREFERRED EMBODIMENT

Figures 1A, 1B, 1C, 1D, 1E:
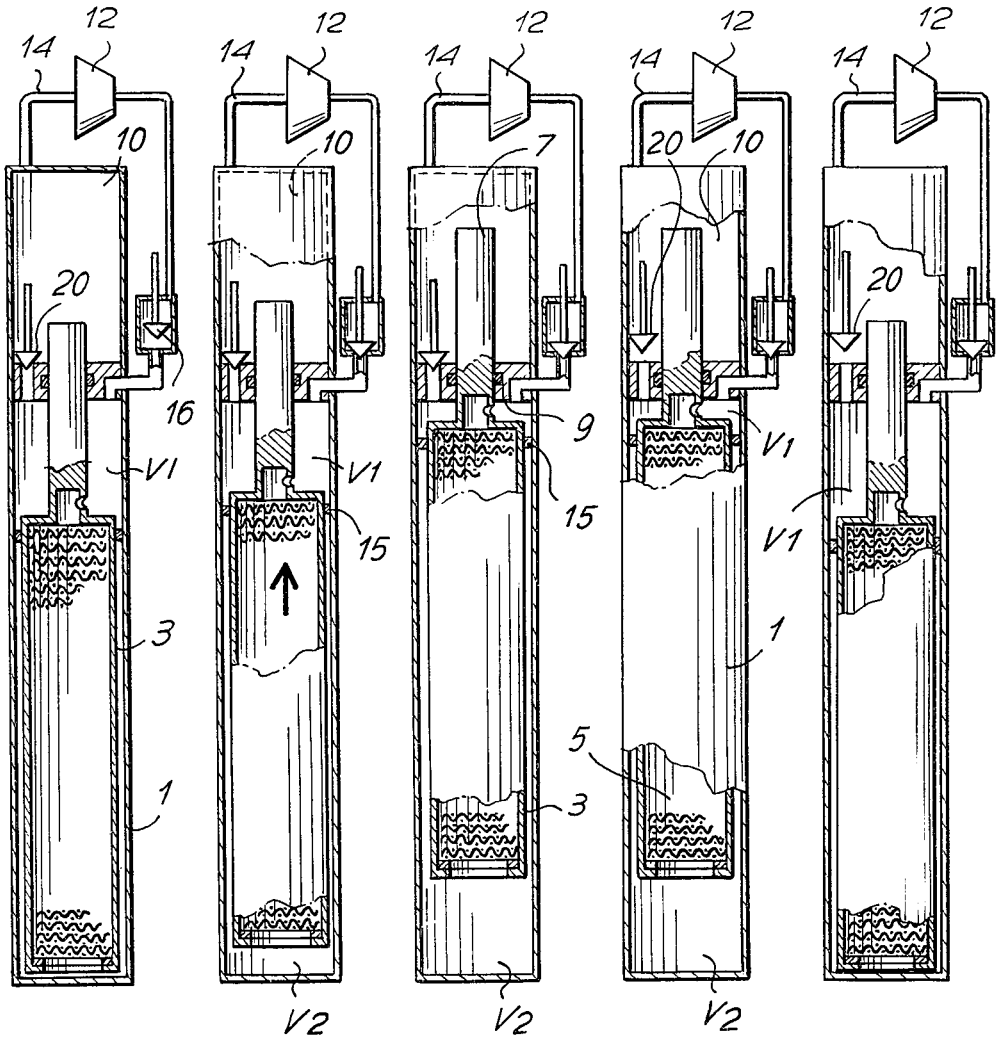
FIGS. 1A–1E show the phases of operations.

According to FIGS. 1A–1E, in a cylinder 1 an oblong piston 3 is slidably disposed which includes a suitable inner thermal exchanger 5. Piston 3 is connected within cylinder 1 by a cylindrical rod 7 which includes a sealing member 9. The end of rod 7 is in a region 10 maintained at low pressure by virtue of an evacuating compressor 12 operating through conduit 14. The seal 15 of piston 3 on cylinder 1 subdivides the cylinder region into two volume regions (V1 being the upper region and V2 the lower region), which communicate through exchanger 5. If in cylinder 1 a gas flows at a higher pressure than that of evacuating compressor 12, a force is created which effects work on piston 3.

Therefore, if gas flows in at pressure, it carries out work on the piston, and the gas expands and cools.

The phases of the cooling cycle are as follows.

In phase A shown in FIG. 1A, piston 3 is placed in the bottom dead center. The opening of the delivery valve 16 occurs with high pressure gas flowing in the cylinder upper region V1, into exchanger 5 and partly in the small volume of lower region V2. The gas flowing in V2 is low temperature gas cooled as it flowed through exchanger 5, which was itself cooled during the preceding cycle.

In phase B shown in FIG. 1B, the displacement of piston 3 toward the top dead center starts. Delivery valve 16 remains open along a portion (about $\frac{1}{4}$) of the stroke, then inlet valve 16 is closed. Now phase C of gas expansion in the V1 and V2 regions and the exchanger starts, with an upward piston thrust to the top dead center, owing to the section of rod 7, which reciprocates within low pressure region 10; the gas cools and at the same time flows through exchanger 5 transferring entirely to region V2.

When the arrangement shown in FIG. 1C is reached, with the piston at the top dead center, the inlet valve 20 is opened and the evacuation of the gas in V2 and the exchanger begins (phase D shown in FIG. 1D). This further expansion causes a further cooling effect both of the exchanger main surface (consisting of the cylinder wall lower portion) where the thermal load is placed, and of exchanger 5 positioned inside main piston 3. All the gas flows again through exchanger 5 in an opposite direction—from V2 to V1 region—and thus the gas also absorbs heat from the exchanger, cools it and enables it to operate in the subsequent cycle.

When the bottom dead center (phase E as shown in FIG. 1E) is reached, inlet valve 20 is closed again and the new cycle starts.

The embodiment for the rod and valve operating apparatus is as follows, with reference to FIG. 2 and the following.

FIGS. 2A to 2C illustrate the main parts permitting the transformation of the rotary motion provided by motor 31 to the reciprocating motion required for the cycling of piston 3. The control rod 7 is operated by motor 31 through the mechanism formed by a guide 33 and an eccentric pin 35, carried by the shaft of motor 31.

During the period of the gas working against the piston to raise it, the electric motor operates as a brake storing energy, which then will be used in the lowering phase of the piston. On the same shaft to which the eccentric unit 35 is splined, there are two control cams 36, 38 for operation, through two levers 40, 42 of inlet (or delivery) valve 44 and evacuation valve 46. Valve adjusting means 40A and 42A are also provided.

The gas inlet occurs either by suitable distribution through control rod 7 with conduits 48, 50 or through bores in the upper cylinder portion, as illustrated in FIGS. 1, 3 and 4.

FIGS. 3 and 4 show the embodiment of the cryogenic system in one-stage and two-stage versions, respectively.

In FIG. 3 the same references numerals as in FIGS. 1 and 2 are used for corresponding elements. In this embodiment passages leading to the inlet and evacuation valves, such as passage 62, are provided in a body 60 which is joined to cylinder 1. Cylinder 1 has two wall thicknesses 1A and 1B. Numeral 64 denotes the wall for the transfer and, therefore, the use of the cooling provided by the device. Numeral 66 denotes an annular cavity extending between region V2 and seal 15.

In FIG. 4 the cylinder consists of two stages 101 and 102 of two cylinder diameters, with two pistons defining volumes V10, V12, V14, communicating through exchangers 108; 110 placed inside the pistons and passages 112, 114, 115. Numerals 116 and 118 denote the areas for the transfer of the cooling provided. Numerals 120 and 122 denote annular cavities between cylinder and piston in the two stages, extending from regions V12 and V14 toward seal 124 and 126 which are spaced apart from cooling regions V12 and V14.

The piston in the one-stage and two-stage embodiments, in the form shown ensures a high thermal exchange at the lower portion of the cylinder to obtain the desired refrigeration, and an adequate insulation from the outside in the portion farthest from the thermal load. The piston effects its reciprocating motion with sealing strip 15 or 124 in the upper part, which remains at room temperature during the entire cycle.

In the annular cavities 66, 120, 122, extending between the room and the cryogenic temperature areas, the gas expands with highly turbulent motion, which ensures a high degree of thermal exchange with the cylinder walls used as cooling surfaces of the load (64 in FIG. 3, 116 and 118 in FIG. 4). The cavities 66, 120 and 122 also serve as a means to insulate the room temperature portions of the apparatus from the cooling surfaces.

Inside heat exchangers 5 in FIG. 3 or 108 and 110 in FIG. 4 materials are disposed in order to insure an effective thermal exchange with the gas. The materials have high cryogenic temperatures, conductivity and thermal capacity. By this arrangement it is possible to obtain, in the short period of time in which the gas flows through the piston, an effective exchange. In the systems illustrated, gas axial passages are provided. Such an embodiment is simple to construct and further permits high efficiency in the exchanger, since the piston contacts, for its entire length, the metal mass which yields and absorbs heat alternately during the cycle phases.

The gas after flowing out of the exchanger flows into region 10 (FIG. 2) through the delivery valve opening. Region 10, constantly maintained at evacuation pressure attenuates the delivery pulsations of the piston unit, and ensures better operation of the evacuating-pressurizing compressor. This compensates for the differences between the cryogenic system gas inlet capacity and the pumping unit evacuation capacity. The gas flowing out region 10 also ensures, by flowing through the space where motor 31 is mounted, an effective cooling of said motor.

The present cryogenic equipment offers cooling, rapidity, low quantities of absorbed energy, and high system reliability since a low number of cycles are required. The use in the present equipment of a cooling cycle in which work and an evacuating effect are provided by the pumping unit, permits the apparatus to be small with respect to the cooling obtained. The combined working and evacuating apparatus also enables the piston rod reciprocating motor to be relatively small.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and the appended claims.

What is claimed is:

1. Closed circuit gas operated cryogenic apparatus comprising:
   (a) a cylinder;
   (b) a piston slidably displaceable within said cylinder;
   (c) heat exchanger means mounted within said piston;
   (d) sealing means mounted to said piston for dividing said cylinder into first and second regions, said first and record regions communicating through said heat exchanger means;
   (e) external means for reciprocating said piston;
   (f) a third region coupled through first valve means to said first region;
   (g) rod means extending from said piston means into said third region;
   (h) compressor means having evacuating and compressing sides, the evacuating side of said compressor coupled to said third region, the pressurizing side of said compressor coupled to said first region whereby said piston is displaceable by both the expansion of said gas and said external means to provide cooling by said expansion of said gas.

2. The apparatus as claimed in claim 1 further including means for coupling said piston to said external means to utilize said external means as brake means when said piston is displaced by said expansion of said gas.

3. The apparatus as claimed in claim 1 wherein said piston is spaced apart from said cylinder by means of an annular cavity to thereby insulate said piston from said cylinder.

4. The apparatus as claimed in claim 1 further including a second cylinder and piston to operate as a second stage of cooling.

5. The apparatus as claimed in claim 1 wherein said valve means coupling said third and first regions are axial with said piston.

* * * * *

UNITED STATES PATENT AND TRADEMARK OFFICE

CERTIFICATE OF CORRECTION

PATENT NO. : 4,235,078

DATED : November 25, 1980

INVENTOR(S) : Piero Morbidi

It is certified that error appears in the above—identified patent and that said Letters Patent is hereby corrected as shown below:

IN THE CLAIMS

Claim 1, Column 4, Line 29 -

"record" should be --second--

Signed and Sealed this

*Twenty-eighth* Day of *April 1981*

[SEAL]

*Attest:*

RENE D. TEGTMEYER

*Attesting Officer*

*Acting Commissioner of Patents and Trademarks*